United States Patent [19]

Collier et al.

[11] 4,178,973

[45] Dec. 18, 1979

[54] TOOL FOR APPLYING BUNDLE TIES

[75] Inventors: John C. Collier, Southport; Leonard J. Owen, Watford, both of England

[73] Assignee: AMP Incorporated, Harrisburg, Pa.

[21] Appl. No.: 936,261

[22] Filed: Aug. 23, 1978

[30] Foreign Application Priority Data

Sep. 6, 1977 [GB] United Kingdom ..... 37098/77

[51] Int. Cl.[2] ..... B21F 9/02

[52] U.S. Cl. ..... 140/123.6; 140/93 A; 140/93.2

[58] Field of Search ..... 140/93 A, 93.2, 123.6

[56] References Cited

U.S. PATENT DOCUMENTS

| | | | |
|---|---|---|---|
| 3,515,178 | 6/1970 | Hidassy | 140/93.2 |
| 3,799,214 | 3/1974 | Countryman | 140/93.2 |
| 3,891,012 | 6/1975 | Bakermans | 140/123.6 |
| 3,931,838 | 1/1976 | Bakermans | 140/123.6 |
| 3,976,108 | 8/1976 | Caveney et al. | 140/93 A |

*Primary Examiner*—Lowell A. Larson

*Attorney, Agent, or Firm*—Allan B. Osborne

[57] ABSTRACT

A tool for applying bundle ties comprises a frame supporting a reciprocable carriage in a guide path leading to a loop guide around which ties are to be driven by the carriage. The carriage is reciprocated by a drive rod having a handle projecting laterally through a slot in the frame for manual operation. A trigger is mounted in a handle of the frame and is coupled to the rod by a clutch arranged to engage the rod on rearward movement of the trigger.

3 Claims, 7 Drawing Figures

TOOL FOR APPLYING BUNDLE TIES

This invention relates to applicator tools for applying bundle ties of the kind having a flexible strap portion extending from an apertured frame for the passage of the free end of the strap.

In AMP Incorporated U.S. patent application Ser. No. 793,661 now U.S. Pat. No. 4,119,124, there is disclosed and claimed a method of applying a bundle tie having a flexible strap extending from an apertured frame for the passage of the strap looped back on itself which comprises arranging a plurality of ties in a stack with strap portions in generally parallel overlapping relationship and extending forwardly from their frame portions arranged in a row at a side of the stack, positioning the stack adjacent the guide path of a reciprocable carriage with the frame of an end tie in the guide path and the strap portion extending forwardly, driving the carriage forwards to engage and drive the end most tie forwardly, lengthwise to loop the strap about a bundle and feed it back through the frame, gripping the reversed leading end of the strap in the carriage, reversing the carriage to tighten the loop, shearing the free end of the strap adjacent the frame, withdrawing the carriage behind the frame of the tie in the stack and moving the stack towards the guide path.

There is also disclosed and claimed a tool for applying to a bundle a bundle tie having a flexible strap extending from an apertured frame for the passage of the strap looped back upon itself, which comprises a chamber for a plurality of ties arranged in a stack with their straps in generally parallel overlapping relationship extending forwardly from their frames arranged in a row, the chamber opening to the guide path of a reciprocable carriage and being adapted to guide the ties directly into the guide path with the strap of the leading tie extending lengthwise forwardly of, and its frame being disposed in, the guide path, a releasable loop guide adapted to embrace the bundle and guide the strap about the bundle and reverse it through the frame, a gripper in the carriage to grip the strap, a shear device movable transversely of the guide path adjacent the loop guide, and means for reciprocating the carriage between a rear side of the chamber and the loop guide.

In the particular tool disclosed and described in our earlier application the carriage of the tool is reciprocated by a pneumatic piston and cylinder device.

In the present invention a tool for applying bundle ties of the kind having a flexible strap portion formed at one end with an apertured frame for passage of the other free end of the strap, the tool comprising a tool frame reciprocably supporting a carriage in a rectilinear guide path leading to a loop guide at a forward end of the guide path, the tool including means for positioning a tie longitudinally in the guide path between the carriage and the loop guide with the tie frame adjacent the carriage, the loop guide being adapted releasably to embrace material to be bundled and defining a concave guide path arranged to engage the leading end of a strap portion driven forwardly by the carriage and to deflect the strap around the concave guide path and back into the rectilinear guide path, releasable gripping means at the carriage for gripping the reversed leading end of the strap portion and a shear device operable transversely of the rectilinear guide path, disposed at the forward end of the frame rearwardly of the loop guide, according to the present invention means for reciprocating the carriage comprise a drive rod extending rearwardly from the carriage and slidably mounted in the tool frame, a handle projecting laterally from the rod through a slot in the frame, and a trigger mounted at a handle of the tool frame coupled to the rod by a clutch device operable to drive the rod rearwards on pulling the trigger.

Suitably the clutch device comprises a block slidable on the rod and having a cavity containing a pivoted sprag pawl arranged to engage the rod at an inclination to its length, the rod having two longitudinally spaced recesses respectively registering with the pawl at forward and rearward limits of the rod movement, the recesses permitting reversal of the pawl inclination to the rod on reversal of rod movement at the limits of its stroke.

The sprag pawl clutch device ensures that the rod, and hence the carriage, is driven to the limits of its stroke in forward and rearward directions and prevents reversal at an intermediate part of the stroke. This helps to prevent misfeed of bundle ties during repeated operations and ensures that one tying operation is completed before the next is commenced.

The trigger suitably comprises a block slidable in the tool frame parallel to the rod guide path, and engaging the block of the clutch device. If the trigger is pulled rearwardly at any part of the rearward stroke of the rod, the sprag pawl drivingly engages the rod so that the trigger force augments the force supplied to the rod handle. In operation the rod handle is driven forwards to traverse a first tie around the bundle to a position in which the strap tip is gripped in the carriage with the carriage at a forward position in the tool frame, and the rear rod recess registering with the sprag pawl. Reversal of the rod handle movement tightens the bundle tie, and as the sprag pawl leaves the rear rod recess, it assumes a rearward inclination relative to the rod to inhibit forward movement of the rod relative to the pawl. When manual force on the rod handle is balanced by the strap tension, the trigger is pulled to add further tension to the tie strap.

Suitably the tie is of a kind having a tip portion designed to fracture when appropriate tension is applied in the strap around the bundle, and the additional trigger force is sufficient to effect this. The carriage at its rearward position is suitably arranged to trip and operate the shear device.

Alternatively, the trigger may be coupled to the shear device for shearing the tie strap when the trigger has moved rearwardly by a predetermined distance.

The invention will now be described by way of example with reference to the accompanying partly diagrammatic drawings in which.

Figure 1:
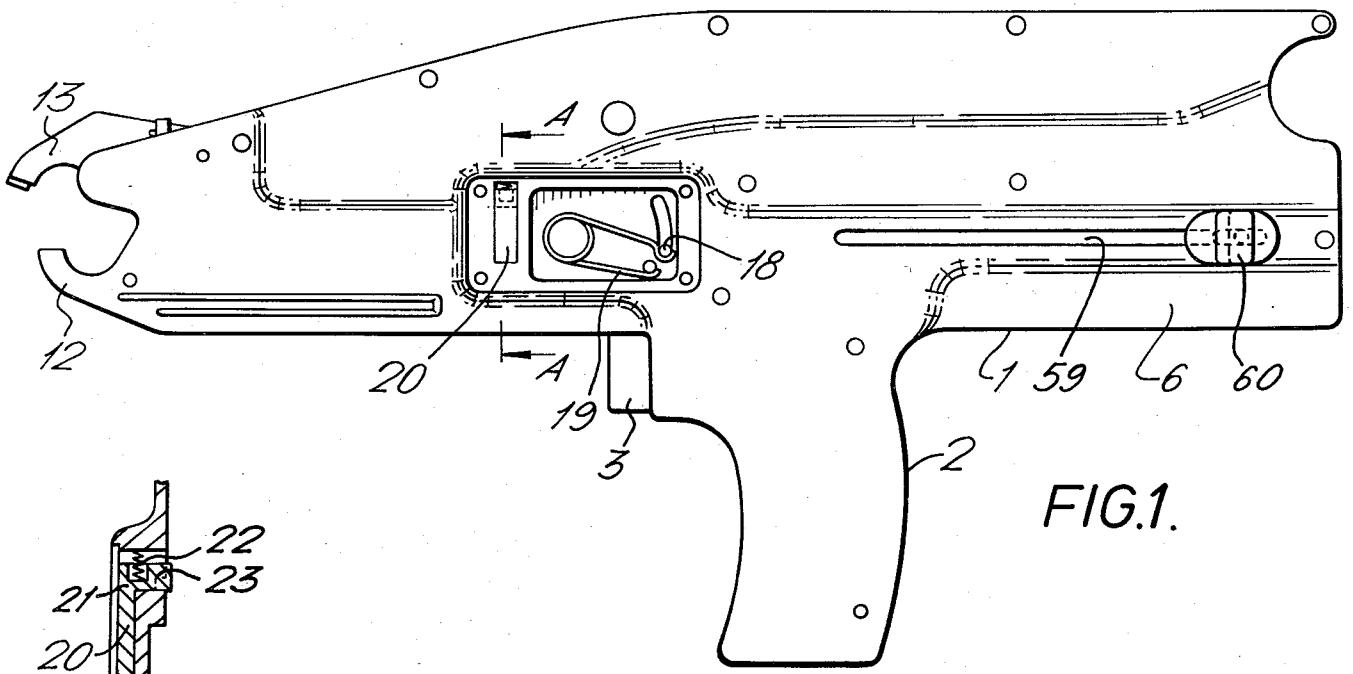
FIG. 1 is a side elevation of a tool according to the invention.
Figure 1A:
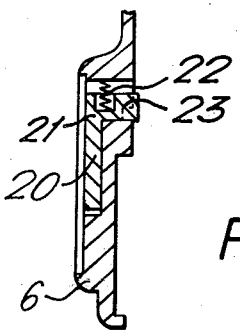
FIG. 1A is a fragmentary section taken on line A—A of FIG. 1, viewed in the direction of the arrows of a side portion of the tool frame.

The tool of FIGS. 1 to 6 is of the kind disclosed and claimed in application Ser. No. 793,661 but embodies manual rather than pneumatic drive means. The tool comprises a frame 1 having a dependant piston-grip handle 2 carrying a finger operated trigger 3 coupled to a rod 5, slidably mounted in the frame 1, by a sprag pawl clutch device 4. The frame 1 is moulded in two halves 6, each comprising a side of the tool, and releasably secured together by fasteners. At the rear, right hand end of the tool as seen in the drawings, the frame 1 projects above the rod 5 to define a tie magazine chamber 9 extending forwardly to the front of the tool. The tool sides 6 are formed with groove guides 8 at the base of the chamber 9 which at the rear end of the tool have an enlarged entry 10 and extend forwardly in progressively increasing downwardly inclined manner towards a middle portion of the tool.

The tool at its forward end is provided with a pair of bundle jaws 12,13 a lower jaw 12 integral with the tool frame 1 and an upper jaw 13 pivotally connected at 14 to the frame 1 for opening and closing movement in relation to jaw 12. The jaw 13 is biased into a closed condition, in anti-clockwise fashion by biasing springs 19 acting through levers 17 and a transverse shear device to be described below.

A pivot 16, defined by bosses on the frame halves extends internally of the frame 1 between the opposite sides 6 at a location forwardly of the handle 2 and slightly below the line of action of the rod 5. A pair of identical plate-like levers 17 is pivotally mounted on pivot 16, extending rearwardly towards handle 2, spaced apart, one on each side of the frame 1 and at rear ends having pins 18 outwardly directed through arcuate slots in the frame and engaging external biasing springs 19 as seen in FIG. 1, adapted to bias the levers 17 counter-clockwise about pivot 16. The springs 19 are disposed in recesses suitably closed by cover plates, not shown, and forwardly of the springs 19, within the same recesses, are disposed further biasing means 20 at the opposite sides of the tool. Each means 20 comprises a block 21 slidable in a slot, vertically as seen in the drawings, transversely of the line of action of the rod 5 and biased downwardly by a compression spring 22. An upper bloc-portion 23 projects through an aperture in the tool side to register with a leading end of the corresponding groove guide 8, as seen in FIGS. 3 to 6, and presents a forwardly and downwardly inclined lower guide surface to the groove guide, suitably inclined more steeply than the groove guide 8.

The rod 5 is coupled within the tool frame to a carriage 26 rectilinearly slidable longitudinally of the frame and between the spaced levers 17. The rod 5 at its rear end is secured within a bushing 7 slidable in the tool frame 1 and extends forwardly through a bearing block 11 secured in the frame 1, to its forward end which is secured to the rear of carriage 26. The sprag clutch device 4 is mounted on the rod 5 rearwardly of bearing block 11 and comprises a block having a bore 27 through which the rod 5 is slidable and a lower pawl cavity 28 communicating with the bore 27. The sprag pawl 34 is pivotally mounted in the cavity 28 projecting upwardly to engage an underside of the rod 5 and is suitably biased towards an upright condition by a lower spring 38.

The trigger 3 is slidable in the frame parallel to the rod 5 on a pair of spaced pins 39, extending transversely between opposite sides of the frame 1 through aligned longitudinal slots 40 in a rear extension of the trigger 3. The slots 40 limit forward and rearward movement of the trigger 3 which is biased to a forward position as in FIGS. 2 to 4 and 6, by a compression spring 44 contained within a cavity in the rear extension of the trigger 3 and acting against the rear pin 39. The trigger 3 is coupled to the body of the sprag clutch device 4 by a drive pin 56.

The rod 5 is formed on its underside with two recesses 57 and 58. The rear recess 58 is disposed forwards of the bushing 7 and the forward recess 57 at a position rearwards of the bearing block 11 when the carriage 26 is in its rearward position, as in FIG. 2, to register with the sprag pawl 34, with the trigger 3 in its forward position.

As seen in FIG. 1, the tool frame 1 is formed on one side with a slot 59 extending parallel to the rod 5 and corresponding in length to the full range of movement of the carriage 26. The bushing 7 is secured to a handle 60 slidable in the slot 59 and projecting externally of the tool frame 1. Suitably the frame is slotted on both sides so that the handle may be positioned to allow for either left or right-hand operation.

Figure 3:
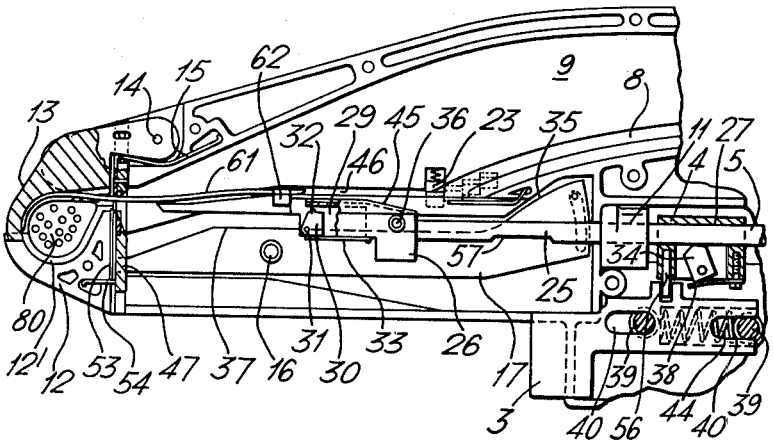
FIGS. 3 to 6 are fragmentary side elevations similar to part of that of FIG. 2 but to an enlarged scale and with the tool mechanism in successive stages of operation.

The carriage 26 at its forward end is formed with an inverted channel-shaped cavity 29 within which is pivotally mounted a gripping member 30 on a transverse pivot pin 31. The member 30 has a tooth 32 movable towards the roof of the cavity 29 by counter-clockwise pivotal movement as seen in FIG. 3, with the tooth 32, when in its uppermost position, being disposed rearwardly of the pivot 31. A lower side of member 30 engages the forward end of a cantilever spring 33 extending from a rear portion of the carriage and arranged to bias the gripping member counter-clockwise about pivot 31 to a gripping condition in relation to the cavity roof. The spring 33 is suitably slotted to present an open floor to the cavity 29.

Figure 6:
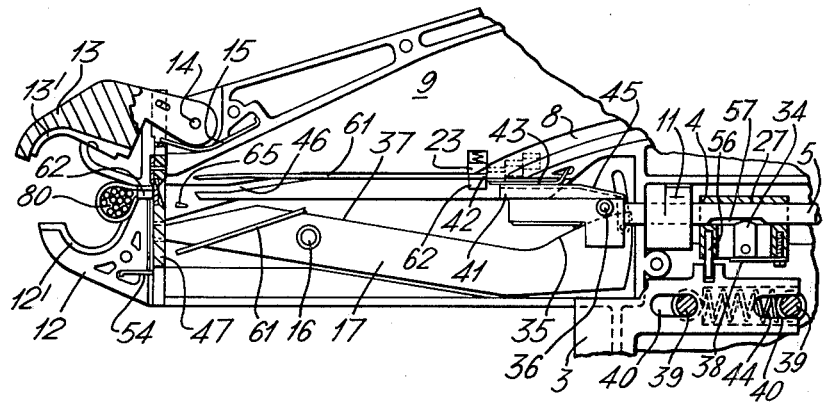

The carriage 26 at a forward end of the cavity 29 and adjacent the cavity roof is formed with a pair of feed prongs 41, one on each side of the cavity, and, as seen in FIG. 6, disposed below an aperture 42 in the frame 1 communicating with the forward ends of the groove guides 8. A cantilever leaf spring 43 secured at its rear end extends forwardly above the forward end of the carriage, when in the rearmost condition of FIG. 6, and part way across the aperture 42. The inwardly projecting block portions 23 and their lower guide surfaces register with the groove guides 8 above the aperture 42, forwardly of the spring 43. The carriage 26 is formed at the upper side of its rear end with an upwardly and forwardly inclined cam surface 45 for deflecting a tie frame upwardly out of its path on rearward movement. Guide grooves 46 are formed in opposite sides 6 of the frame 1 and extend forwardly from the aperture 42 at a location above the feed prongs 41 in their FIG. 6 condition, to the forward end of the tool to intersect the path of a transversely operable shear and stop member 47. The grooves 46 have forwardly and downwardly inclined middle portions, leading to forward portions aligned with the path of the feed prongs 41. The grooves 46 have lower sides which terminate short of the shear and stop member 47 by at least the length of a tie frame, to facilitate clearing the tool in the event of a misfeed. The sides of the frame 1 at the grooves 46 are spaced by a slot extending forwardly from the aperture 43 at which the magazine chamber 9 opens to the guide path of the carriage 26, for the passage of strap portions of ties from the magazine into the guide path.

The shear and stop member 47 is slidably supported in a vertical guide within the frame 1 for limited up and dowm movement. Forward ends of levers 17 engage slots in opposite sides of member 47, for lifting and lowering the member by movement of the levers 17 about pivot 16. Upper portions of the member 47 are pivotally connected to the upper jaw member 13 for opening the jaws on upward movement and closing the jaws on downward movement of member 47. The lever biasing springs 19 serve to bias the shear member 47 downwards and the upper jaw 13 to a closed condition. The levers 17 have at their rear ends upper, forwardly and downwardly inclined surfaces 35 arranged to be engaged by pins 36 projecting from the carriage 26, on movement of the carriage to its rearmost, FIG. 6, condition, to drive the levers 17 against the biasing springs 19 in a clockwise direction to elevate the member 47 and open the upper jaw 13. The levers 17, forwardly of surfaces 35 are formed with rectilinear surfaces 37 extending forwardly of the pivot 16 and serving to engage the pins 36 on forward movement of the carriage 26. The pins 36 suitably carry rollers for engaging the levers 17.

The shear and stop members 47 comprises a frame having an aperture generally aligned with the forward ends of the guide grooves 46 and the path of the feed prongs 41 of the carriage 26. A shear blade is mounted in the frame at a lower side of the aperture and at an upper side is disposed a block of resilient plastics material, slidable relative to the frame of the shear member and secured to a plate at a forward side of the frame 47 and locating in grooves in the tool frame sides to secure the block against movement. The plate provides an anvil for the shear blade. A pawl device is slidably mounted on the block, biased downwards by spring 15 to latch behind tie frames passed through the aperture in the shear and stop member.

At a forward side of member 47 extending downwardly from aperture is disposed a latch plate 53 vertically slidable relative to member 47 and supported at its lower end on a cantilever spring 54 normally supporting the upper end of the latch plate slightly above the shear blade when member 47 is in its lower, FIG. 3, condition. Upward movement of the latch plate 53 is suitably limited by a projection engaging a stop in the tool frame.

Figure 4:
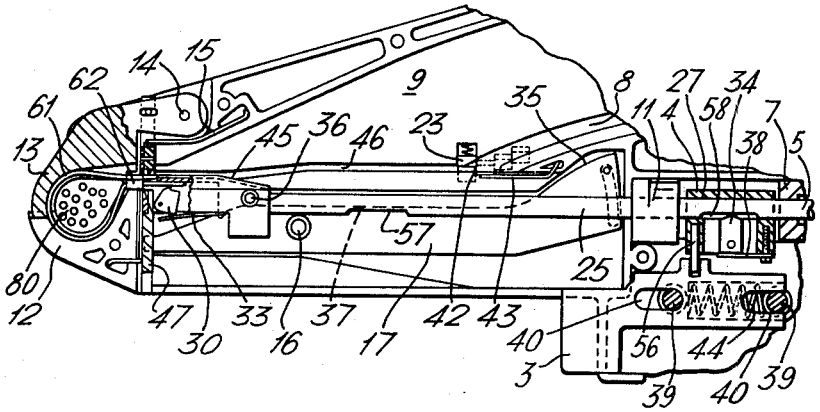
Figure 5:
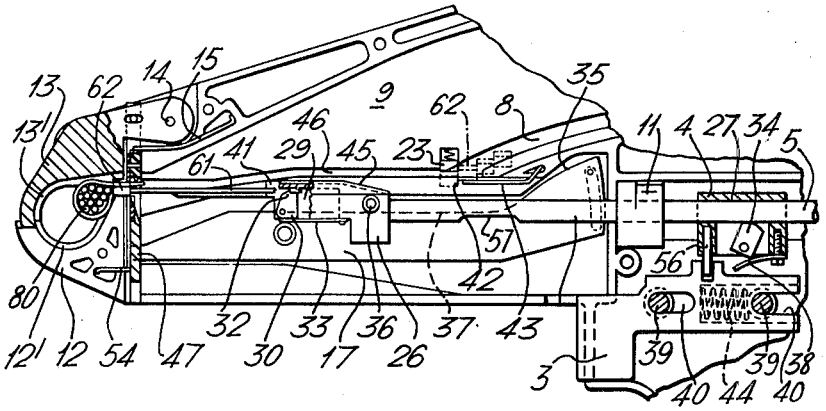

The tool jaws 12 and 13 are formed on their inner sides with guide grooves 12', 13' adapted to form, when the jaws 12 and 13 are closed as in FIGS. 3 to 5, a loop of grooved form extending from the throat or aperture 48 communicating with the guide path of the feed prongs of the carriage 26 which extends generally tangentially of an upper side of the loop.

For use in the tool of FIGS. 1 to 6, plurality of ties having strap portions 61 and frame portions 62 is suitably packaged in a stack 63 mounted in the chamber 9. The tongues of lower ties snap-fit into the frame apertures of superjacent ties and consecutive strap portions 61 extend in parallel overlapped fashion. The frame portions 62 of adjacent ties project downwardly in closely spaced overlapping fashion to define a sloping stack which is flexible to correspond to the path defined by the guide grooves 8 of the tool magazine chamber 9. Stack forming ties of this kind form the subject of AMP Incorporated patent application Ser. No. 793,565, now U.S. Pat. No. 4,079,485.

Figure 2:
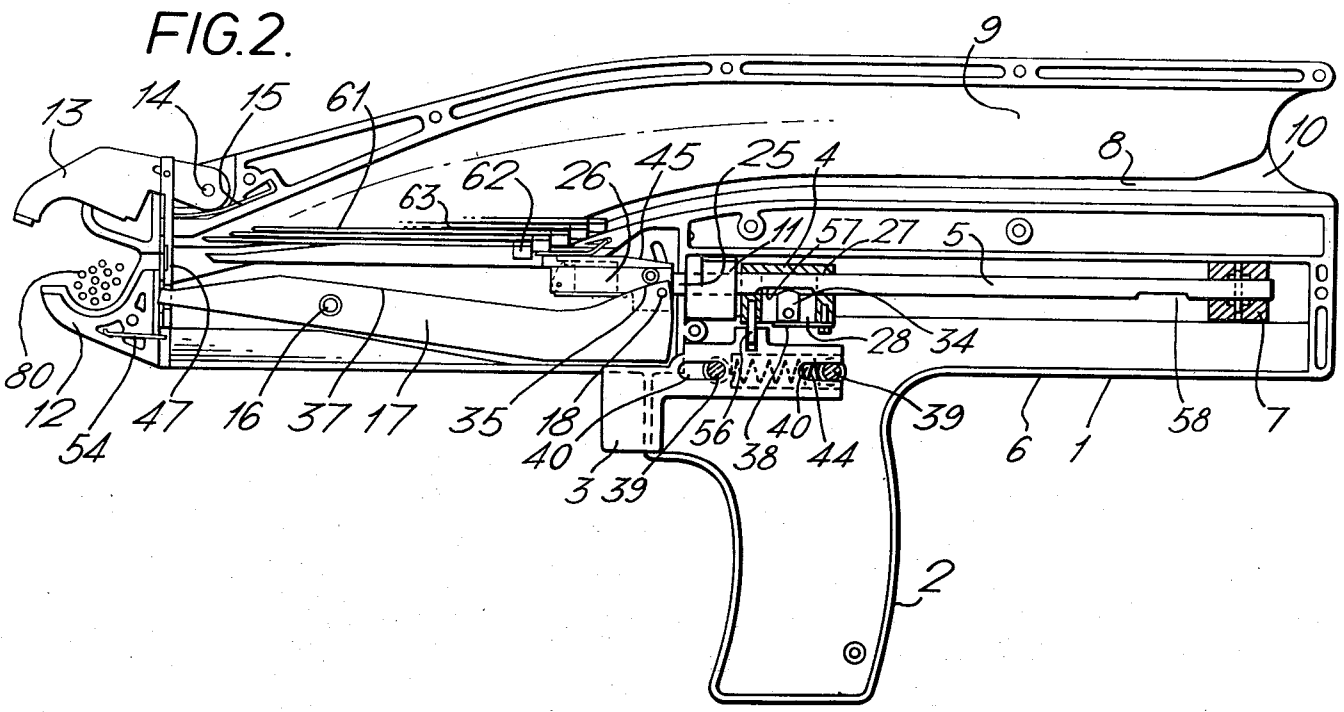
FIG. 2 is a side elevation of the tool of FIG. 1 with a side removed to expose the tool mechanism in an initial condition of operation.

The stack 63 of ties is loaded into the magazine from the upper right hand end as seen in FIG. 1 with strap portions 61 foremost and with the frames 62 directed downwardly as in FIG. 2.

Guide ribs on the tie frames are disposed in the groove guides 8. The strap portions 61 are of length to extend from the aperture 45 to a position short of the rear of the shear and top member 47 as indicated in FIG. 2. The lowermost tie in the stack has its frame 62 registered with the aperture 42 forwards of the spring 43 and in the path of the forward ends of the feed prongs 41.

The lower guide surfaces 23 of blocks 21 engage the head 62 of the leading, lowermost tie to urge the head downwardly through the aperture 42 and past the end of spring 40. In this condition, the lower side of the head 62 of the succeeding, superposed tie engages the upper side of spring 43.

The tool is held in one hand at the pistol grip and the other hand of an operator controls the handle 60. To operate the tool from the FIG. 2 starting condition, with the drive rod 5 and carriage 26 in rearward position, the open bundle jaws are positioned about a bundle of cables 80 and the rod 5 and carriage 26 are driven forwards to the FIG. 3 condition by pushing the handle 60 forwards in the tool frame 1. The feed prongs 41 drive the leading tie forwards to withdraw it from the stack 63. The ribs on the leading tie head engage the guide grooves 46 which serve to lower the frame 62 of the tie, as it moves forwards, until a tongue on the tie head is positioned between the feed prongs 41. The frame of the preceding tie is drawn forwardly of the spring 43 and driven into the aperture 42 by the biasing action of surfaces of blocks 21 after the carriage 26 has moved forwards.

Initially as shown in FIG. 2 the sprag pawl was in an upright position within the forward rod recess 57 and on initial forward movement of the rod 5 to the FIG. 3 condition the pawl is engaged by the rear end of the recess and deflected to a forward inclination relative to the rod 5 against bias of spring 38. In this condition reverse movement of the rod is resisted by wedging action of the pawl 34.

The pins 36 move forwards with the carriage 26, disengaging from the lever surfaces 35, and allowing the levers to move counter-clockwise about pivot 16 under the bias of springs 19 to lower the device 47 and close the upper bundle jaw 13 about the bundle 80. The leading end of the tie strap 61 is driven between opposite sides of the shear and stop member 47, above the lowered shear blade 49 through the aperture and against the upper bundling jaw 13, into its guide groove 13', which deflects it downwardly.

Continued forward movement of the rod 5 to the FIG. 4 condition drives the leading end of the tie strap 61 around the loop path defined by the bundling jaws 12,13 to engage the strap underside at a location close to the frame 62. Simultaneously the frame 62 enters between the sides of the shear and stop member to elevate the pawl device and deflect the latch plate 53 against its spring as the frame 62 passes through the aperture of device 47. As soon as the frame 62 clears the aperture, the spring 54 lifts the latch plate to engage behind a latch pawl of the tie within the frame 62, and side portions of the pawl device are urged down behind the frame 62 under the bias of spring 15, to stop the head 62 against rearward movement.

The leading end of the tie strap 61 enters the frame 62 and passes through the aperture above the shear blade 49, and between the feed prongs 41 to a location below the roof 40 of the cavity at the forward end of the carriage 26 where it is gripped by the tooth 32 of gripping member 30 under the bias of spring 33.

The carriage 23 is now in its fully forward position, as shown in FIG. 4. To start withdrawing the carriage 26 the handle 60 is pulled rearwardly. In the FIG. 4 condition, the pawl 34 engages the rearward recess 58 of rod 5 and is biased to an upright condition by spring 38 and on initial rearward movement of handle 60, the forward end of the rear recess 58 deflects the pawl 34 to a rearward inclination relative to the rod 5, as seen in FIG. 5. In this condition, reversal of the rod withdrawal is inhibited by the wedging action of the pawl. The leading end of the tie strap 61 is gripped in the leading end of the carriage 23, the tie head 62 is held by the latch plate and the pawl device so the tie is tightened about the cable bundle 80 until the pull on handle 60 is balanced by the tension. In this condition whilst maintaining the pull on handle 60, the trigger 3 is pulled to augment the force on handle 60 through the clutch device 4 and the wedging action of the sprag pawl 34 until the tension in the tie exceeds a value determined by the failure strength of the tip of the tie strap. When this is exceeded the tie tip is severed as seen in FIG. 5 and the strap 61 is secured in the frame 62 of the tie by action of a pawl in the tie frame engaging teeth in the strap portion.

Further withdrawal of the rod 5 ensues due to the pull on handle 60, and effects engagement of the pin 36 of the carriage 26 with the lever surface 35 to move the levers clockwise about pivot 16 to elevate the shear blade 56 to sever the leading end of the tie strap 61 and the tongue of the tie adjacent the frame 62, as seen in FIG. 6. Elevation of the shear and stop member 37 simultaneously effects opening of the bundling jaws 12,13 to release the tied bundle 80.

The shear blade enters the recess at the forward side of the plastics block which serves to deflect the sheared portions of the tongue and strap portion downwards through an open slot in the tool frame.

The carriage is withdrawn, deflecting the leading tie head 62 upwards from the path by cam surface 35, to position the feed prongs 41 below the leading end of spring 43, and the next leading tie head 62 is urged downwards by plunger 44 into the aperture 42 to register with the feed prongs 41. The tool is now restored to the starting condition of FIG. 2, by releasing the pull on trigger 3 which is driven from the FIG. 5 to the FIG. 6 condition by the biasing of spring 44, and the operational sequence may be repeated to effect a further tying operation at a different location. On the next cycle of operation, when the tool reaches the stage of FIG. 4, the tip of the tie strap entering the cavity between gripping member 30 and the cavity roof serves to eject the tie strap tip severed in the previous cycle which falls through the aperture in spring 33 and the slot in the tool frame.

We claim:

1. A tool for applying bundle ties of the kind having a flexible strap portion formed at one end with an apertured frame for passage of the other free end of the strap, the tool comprising a tool frame reciprocably supporting a carriage in a rectilinear guide path leading to a loop guide at a forward end of the guide path, the tool including means for positioning a tie longitudinally in the guide path between the carriage and the loop guide with the tie frame adjacent the carriage, the loop guide being adapted releasably to embrace material to be bundled and defining a concave guide path arranged to engage the leading end of a strap portion driven forwardly by the carriage and to deflect the strap around the concave guide path and back into the rectilinear guide path, releasably gripping means at the carriage for gripping the reversed leading end of the strap portion, and a shear device operable transversely of the rectilinear guide path, disposed at the forward end of the frame rearwardy of the loop guide, characterised by means for reciprocating the carriage comprising a drive rod 5 extending rearwardly from the carriage 26 and slidably mounted in the tool frame 1, a handle 60 projecting laterally from the rod 5 through a slot 59 in the frame 1, and a trigger 3 mounted at a handle 2 of the tool frame 1 coupled to the rod 5 by a clutch device 4 operable to drive the rod 5 rearwards on pulling the trigger 3.

2. A tool as claimed in claim 1, characterised in that the clutch device 4 comprises a block 4 slidable on the rod 5 and having a cavity 28 containing a pivoted sprag pawl 34 arranged to engage the rod 5 at an inclination to its length, the rod 5 having two longitudinally spaced recesses 57,58 respectively registering with the pawl 34 at forward and rearward limits of the rod movement, the recess 57,58 permitting reversal of the pawl inclination to the rod 5 on reversal of rod movement at the limits of its stroke.

3. A tool as claimed in claim 2 characterised in that the trigger 3 comprises a block slidable in the tool frame 1 parallel to the rod 5 guide path, and engaging the block 4 of the clutch device.

* * * * *